US005828035A

United States Patent [19]

Kuroda

[11] Patent Number: 5,828,035

[45] Date of Patent: Oct. 27, 1998

[54] WEB-TYPE HEATING APPARATUS WITH MOVABLY SUPPORTED HEATER

[75] Inventor: Akira Kuroda, Numazu, Japan

[73] Assignee: Cannon Kabushiki Kaisha, Japan

[21] Appl. No.: 688,641

[22] Filed: Jul. 29, 1996

[30] Foreign Application Priority Data

Jul. 28, 1995 [JP] Japan ..... 7-212696

[51] Int. Cl.[6] ..... G03G 15/20

[52] U.S. Cl. ..... 219/216; 399/329

[58] Field of Search ..... 399/329, 335; 219/216, 469, 536, 546

[56] References Cited

U.S. PATENT DOCUMENTS

| | | | |
|---|---|---|---|
| 5,091,752 | 2/1992 | Okada | 399/329 |
| 5,196,895 | 3/1993 | Setoriyama et al. | 399/328 |
| 5,386,281 | 1/1995 | Mitani et al. | 399/329 |
| 5,404,214 | 4/1995 | Yoshimoto et al. | 399/329 |
| 5,493,379 | 2/1996 | Kuroda et al. | 399/335 |
| 5,499,087 | 3/1996 | Hiraoka et al. | 399/329 |

FOREIGN PATENT DOCUMENTS

| | | |
|---|---|---|
| 63-313182 | 12/1988 | Japan . |
| 1-263679 | 10/1989 | Japan . |
| 2-157878 | 6/1990 | Japan . |
| 4-044075 | 2/1992 | Japan . |
| 4-044076 | 2/1992 | Japan . |
| 4-044077 | 2/1992 | Japan . |
| 4-044078 | 2/1992 | Japan . |
| 4-044079 | 2/1992 | Japan . |
| 4-044080 | 2/1992 | Japan . |
| 4-044081 | 2/1992 | Japan . |
| 4-044082 | 2/1992 | Japan . |
| 4-044083 | 2/1992 | Japan . |
| 4-70688 | 3/1992 | Japan . |

*Primary Examiner*—Robert Beatty

*Attorney, Agent, or Firm*—Fitzpatrick, Cella, Harper & Scinto

[57] ABSTRACT

An image heating apparatus includes a heater; a supporting member for supporting the heater; a film having a first side in slidable contact with the heater and a second side movable with a recording material carrying an image in contact therewith; wherein the image on the recording material is heated by heat from the heater through the film; wherein the heater is movably supported (i.e. with play) on a heater supporting portion of the supporting member without adhesive material therebetween.

17 Claims, 6 Drawing Sheets

WEB-TYPE HEATING APPARATUS WITH MOVABLY SUPPORTED HEATER

FIELD OF THE INVENTION AND RELATED ART

The present invention relates to an image heating device applicable to an image forming apparatus such as a copying machine or printer, and more particularly to a device for heating an image on a recording material by heat from a heating element through film.

A film heating type heating device has been proposed by the assignee of this application in Japanese Laid Open Patent Application No. SHO-63-313182, Japanese Laid Open Patent Application No. HEI-1-263679 Japanese Laid Open Patent Application No. HEI-2-157878, Japanese Laid Open Patent Application No. HEI-4-44075-44083 or the like.

In this, a heater having a heat generating element generating heat upon energization thereto is supported on a supporting member, and the heating element and an elastic pressing roller as a pressing member are pressed to each other with a heat resistive film material (or sheet material) therebetween to form a heating nip. Between the pressing roller and the hear resistive film material, a member to be heated is introduced and is fed through the nip together with the heat resistive film material by which thermal energy of the heater is applied to the member to be heated through the heat resistive film material in the heating nip. This type is advantageous in that the used heater has a low thermal capacity with high temperature rise speed (quick start feature) and can concentratedly apply the heat.

The heating device is usable as an image heating device for the image fixing in an image forming apparatus such as copying machine or printer, more particularly as a heating device for heat-fixing, into a permanent fixed image, an unfixed toner image formed and carried on a recording material (transfer material photosensitive paper electrostatic recording paper of the like) through an image formation process (transfer type or direct type) such as electrophotographic process, electrostatic recording process, or magnetic recording.

As an example of a heater having a low thermal capacity with high temperature rise speed, there is a so-called ceramic heater having a high thermal conductivity ceramic substrate of heat-resistivity and insulative property, and a heat generating resistor printed or sintered thereon. The electric power is supplied to the heat generating resistor to generate heat.

However, is such a conventional heating device, there are following problems since the heater is bonded and fixed to the heater holder.

It is necessary to use an adhesive material of heat curing type as the adhesive material for the heater, man-hour and cost in the assembling is large because of curing of the adhesive material.

There is a difference in thermal capacity and thermal expansion coefficient between the heater and the heater holder of heat resistive resin material, and there is a liability that the heater fixed on the heater holder is broken due to internal stress (thermal stress) in the usual heating.

SUMMARY OF THE INVENTION

Accordingly, it is a principal object of the present invention to provide an image heating device wherein assembling process and and cost relating to the heater can be reduced.

It is another object of the present invention to provide an image heating device wherein damage of the heater due to the inside stress, is prevented.

It is a further object of the present invention to provide an image heating device wherein the heater is movably supported relative to the heater supporting portion of the supporting member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 5, (*b*) is a back side view of a heater.

DESCRIPTION OF THE PREFERRED EMBODIMENTS

Referring to the accompanying drawings, the embodiments of the present invention will be described.

(1) Image Forming Apparatus

Figure 1:
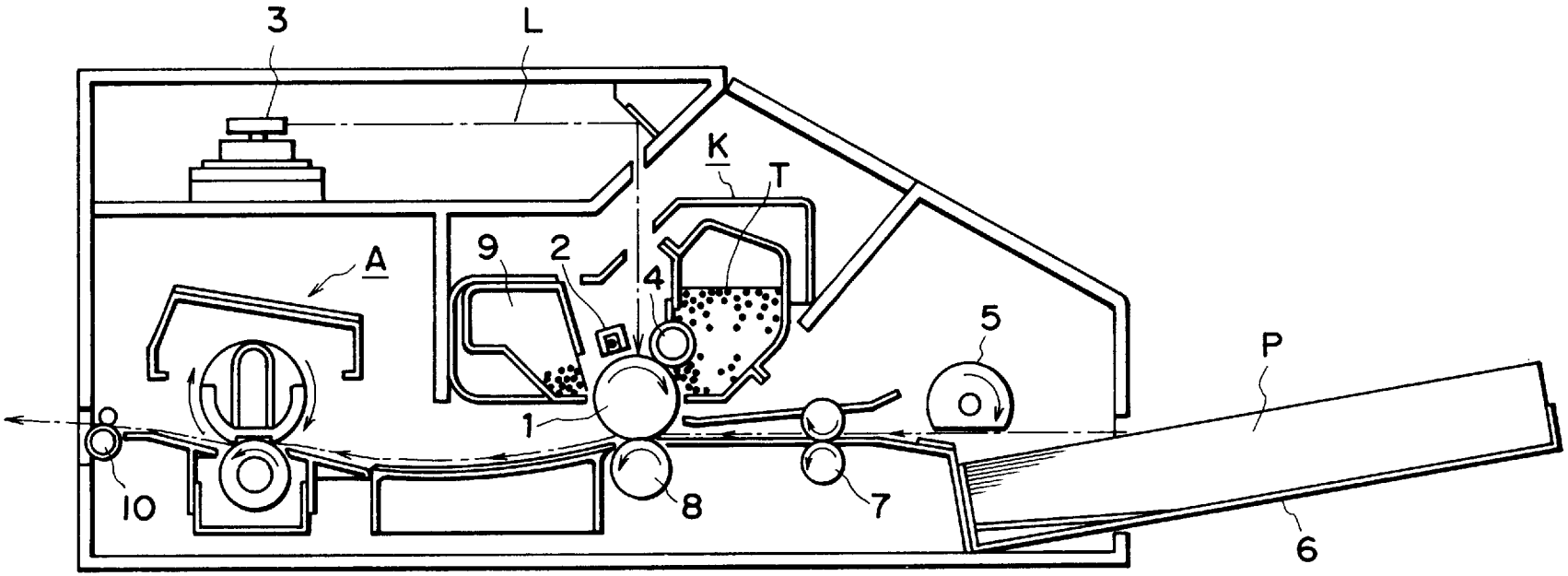
FIG. 1 is an illustration of an image forming apparatus using an embodiment of the present invention.

FIG. 1 is a schematic view of an example of an image forming apparatus according to an embodiment of the present invention. The image forming apparatus of this example is a laser beam printer of process cartridge mounting-and-demounting type using image transfer type electrophotographic process.

Designated by 1 is a rotatable drum type electrophotographic photosensitive member (drum) as a first image bearing member. The drum 1 is rotated at a predetermined peripheral speed (process speed) in the clockwise direction indicated by the arrow, and during the rotation, it is uniformly charged to a predetermined polarity and potential by a primary charger 2.

Then, the surface having been thus charged is exposed to a scanning laser beam L which is modulated corresponding to an electrical digital image signal indicative or intended image information, so that an electrostatic latent image corresponding to the image information is formed.

Subsequently, the latent image is subjected to a reverse development with toner T by the developing device 4, so that the toner is deposited on the part having been exposed to the laser beam.

On the other hand, a transfer sheet P as a second image bearing member (recording material) is fed one by one out of a sheet feeding cassette 6, by operation of a sheet feeding roller 5, and is introduced into the device. The transfer sheet P is fed, at a predetermined timing, into the transfer nip formed between the drum 1 and the transfer roller 8, by a pair of registration rollers. In the transfer nip, said toner image is transferred from the surface of the drum 1 onto the feeding transfer sheet.

The transfer sheet having passed through the transfer nip, is separated from the surface of the rotatable drum 1, and is introduced into image heat-fixing device A which will be described in detail hereinafter, and is subjected to a fixing process for the toner image under the predetermined temperature and pressure, and then is discharged to the outside by the sheet discharging rollers 10.

After separation of the transfer sheet, the rotatable drum 1 surface is cleaned by a cleaning device 9 so that residual matter such as untransferred toner is removed, so as to be prepared for repeated imaging forming operation.

The printer of this example is usable with a process cartridge K containing four process means, namely, the drum 1, the charger 2, the developing device 4 and cleaning device 9, the process cartridge K being detachably mountable relative to the main assembly of the printer.

(2) Image Heat-fixing Device A

Figure 2:
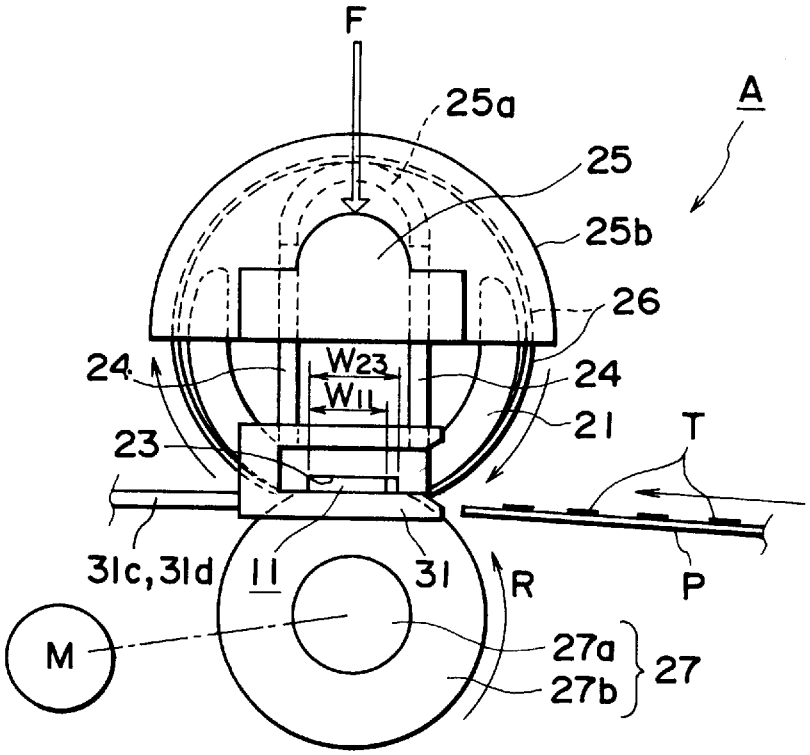
FIG. 2 is a side view of the image heating device.

The image heat-fixing device A of this example is a heating device of tensionless type, film heating type and pressing roller driving type. FIG. 2 is a side view of a major part of the device A, and FIG. 3 is a cross-sectional view of a major part, and FIG. 4 is an exploded perspective view.

Figure 3:
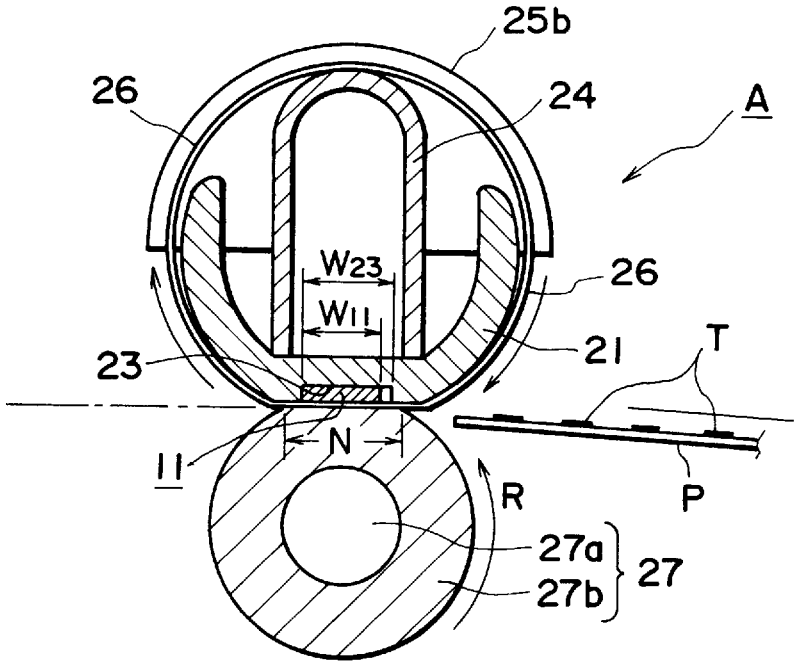
FIG. 3 is a sectional view of the image heating device.
Figure 4:
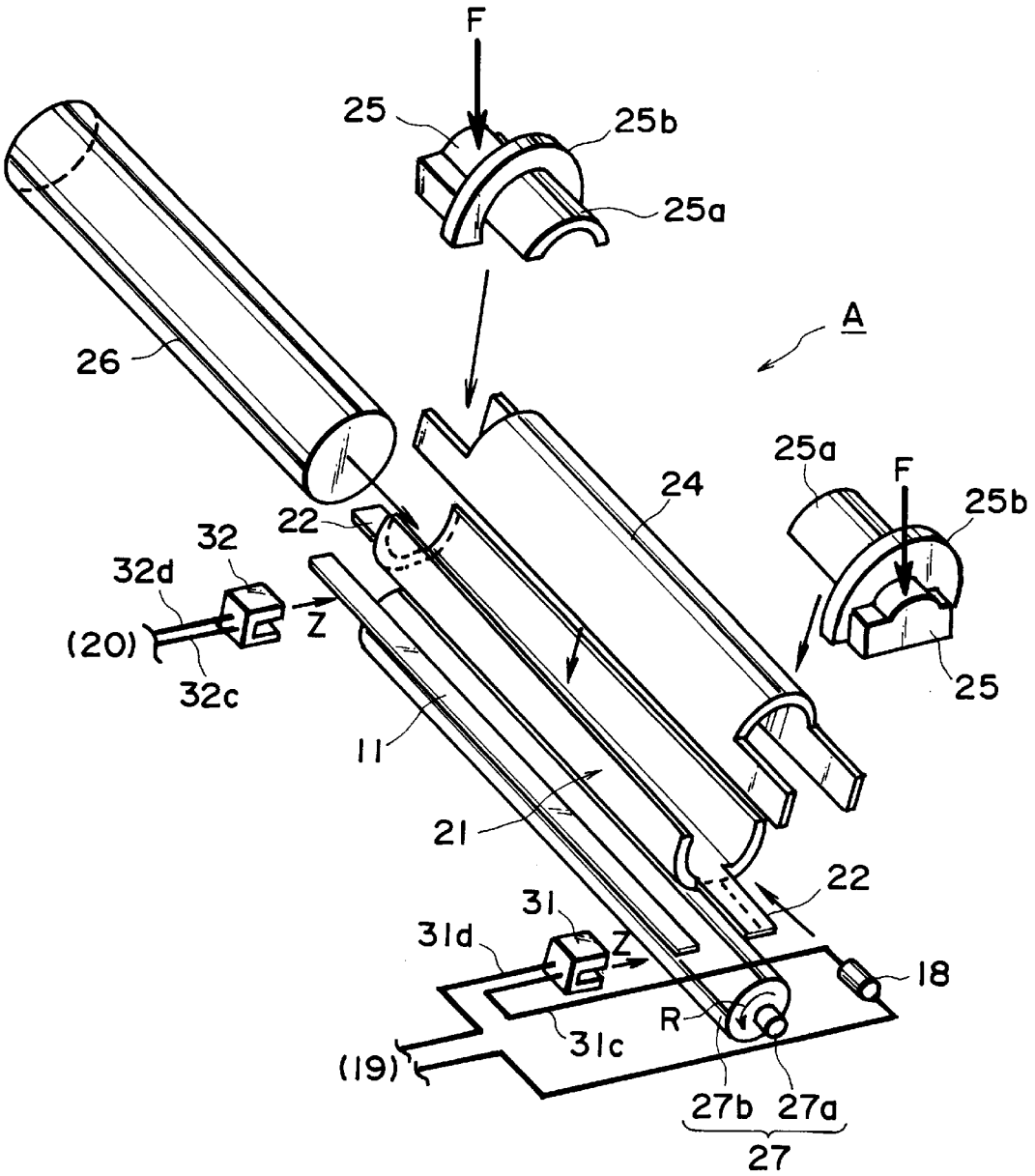
FIG. 4 is an exploded perspective view of the image heating device.

Designated by 11 is a heater, in this example, it is an elongated flat thin ceramic heater extended in a direction perpendicular to the sheet of the drawing in FIGS. 2, 3. The description will be made as to the heater 11 in section (3).

Designated by 21 is a heater holder of elongated trough-type having a substantially semicircular shape in the cross-section. The heater holder 21 also functions as a rotatable guiding member (film guiding member) for a cylindrical film 26, which will be described hereinafter.

Designated by 22 and 22 (FIG. 4) are extended projected portions projected outwardly from opposite end portions of the heater holder 21, respectively. The heater holder 21 is a molded product of heat resistive resin material such as PPS or liquid crystal polymer, for example, including the extended projected portions 22, 22.

A substantially central portion of the lower surface of the heater holder 21 is provided with a groove 23 for receiving the heater, and the groove extends along the length of the holder, including the lower surfaces of the extended projected portions 22, 22.

The width $W_{23}$ of the groove portion 23 is larger than the width $W_{11}$ of the heater 11 by a predetermined degree. The heater 11 is not bonded in the groove portion 23, but is received. Therefore, the heater 11 is loosely fitted in the groove portion 23 of the holder 21, and is not bonded or fixed, so that a mobility (play) is provided in the width of the groove portion 23.

Designated by 24 is a reinforcing member of elongated U-shape faced down in the cross-section and is disposed in the heater holder 21.

Designated by 25 and 25 (FIG. 4) pushing members are pushing mounted to an upper cut-away portions of the reinforcing member 24, and has a portion supplementing the upper cut-away portions at the opposite end portions of the reinforcing member 24 and a flange portion (jaw portion) 25*b* for regulating the end portion of the fixing film 26, which will be described hereinafter.

Designated by 26 is a cylindrical heat resistive film (fixing film). The fixing film 26 is a monolayer film having a heat-resistivity, toner parting property and toughness, or a complex layer film having been subjected to a desired surface treatment or lamination treatment. In this example, it is a polyimide (PI) film, and is a heat-resistive monolayer film having a thickness of 50 $\mu$m, or a complex layer film given a parting property by tetrafluoroethyrene (PTFE).

The heater 11 is received by the groove portion 23 in the lower surface of said heater holder 21, and the reinforcing member 24 is set inside the heater holder 21. Around the heater holder 21, heater 11, the reinforcing member 24, and the cylindrical fixing film 26 are loosely placed. The pushing members 25 and 25 are mounted to the opposite ends of the reinforcing member 24.

Designated by 27 is a pressing roller as a pressing member comprising a core metal 27*a* and a heat resistive elastic layer 27*b* of silicone rubber or the like. The pressing roller 27 is rotatably supported by bearings at the opposite end portions of the core metal 27*a* and is extended between the side plates.

The heater assembly 11, 21–26 is positioned between the side plates with the heater 11 side facing down, at the upper side of the pressing roller 27. Predetermined downward pressing forces F and F (for example, total pressure of 4–8 Kg for A1 width) are applied to the pushing members 25, 25 by a pressing member such as an unshown pressing spring, by which the heater assembly 11, 21–26 is pressed on the upper surface of the pressing roller 27, so that the heater 11 and the pressing roller 27 are urged to each other against the elastic of the heat resistive elastic layer 27*b* of the pressing roller 27 with the fixing film therebetween to form a fixing nip having a predetermined width (heating nip) N.

The driving force is a transmitted to the pressing roller 27 from a driving source M through a power transmission mechanism such as unshown gears so as to be rotated in the counterclockwise direction R indicated by the arrow at a predetermined peripheral speed.

By the rotation of the pressing roller 27, the cylindrical fixing film 26 is rotated by the frictional force between the pressing roller 27 and the outer surface of the fixing film 26 in the fixing nip N, so that the film 26 is rotated in the clockwise direction indicated by the arrow around the heater holder 21 functioning also as a film rotatable guiding member, while the inner surface of the film 26 is in close contact to the lower surface which is a surface of the heater 11 in the fixing nip N. The reinforcing member 24 also function film rotatable guiding member to guide the inner surface of the cylindrical film 26 by it upper surface. It is preferable to apply a lubricant such as heat resistive grease between the inner surface of the film 26 and the lower surface of the heater to reduce the sliding resistance therebetween.

Designated by 31 and 32 are heater connectors for electric energy supply and temperature sensing relative to heater 11. The heater connector 31 for the electric energy supply is mounted to the extended projected portion 22 at one of the opposite end portions of the heater holder 21, and the heater connector 32 for the temperature sensing is mounted to the extended projected portion 22 at the other side.

Electric power is supplied to the heat generating resistor portion 13 of the heater 11 through the heater connector 31 for electric energy supply so that the temperature of the heater 11 rises, as will be described in (3). Temperature information of the heater 11 is supplied to a control means through the heater connector 32 for temperature sensing, and the electric power supply to the heater 11 is controlled so as to maintain a predetermined temperature.

By the rotation of the pressing roller 27, the film 26 is rotated, and while the heater 11 is controlled at a predetermined fixing temperature (not less than 150 deg., for example) a transfer sheet P as a material to be heated having an unfixed toner image T is introduced into between the rotatable pressing roller 27 and the rotatable film 26 in the fixing nip N, with the toner image carrying surface being faced to the film 26 side. It is fed by the nip with the surface thereof in close contact with the outer surface of the film 26, by which the heat of the heater 11 is applied to the transfer sheet through the film 26 so that the toner image T is heated and fixed on the surface of the transfer sheet P. The transfer sheet P having passed through the fixing nip N is separated from the outer surface of the film 26, and continues to be fed.

Such a film heating type device A can use a small thermal capacity and quick start heater 11, so that the time period required for the temperature of the heater 11 to reach the predetermined temperature, can be significantly reduced. It can be quickly heated to a high temperature even from a normal temperature, and therefore, the so-called stand-by temperature control is not necessary so that electric power saving is accomplished.

In the case of the device A of this example, the film 26 is substantially tension free other than the portion corresponding to the fixing nip N, and therefore, the lateral film shifting force is small. Therefore, as for the film deviation regulating means, flange portions 25*b*, 25*b* for simply stopping the lateral end portions of the film are enough, so that the device structure can be simplified.

Figure 5:
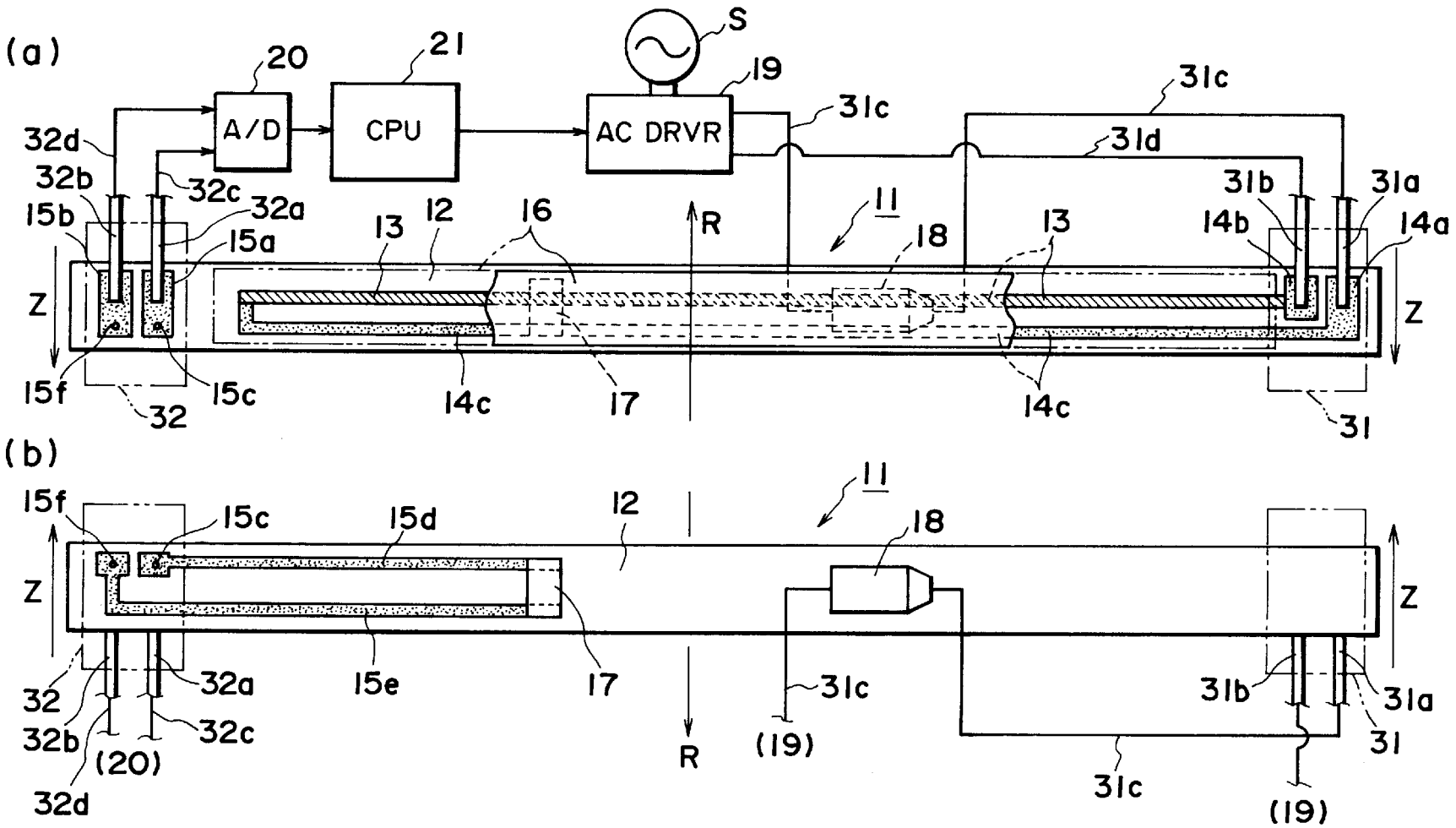
FIG. 5, (*a*) is a front side view of the heater.

(3) Structure of Heater 11 and Electric Energy Supply and Temperature Control System FIG. 5, (*a*) is a partly broken plan view of the heater 11, and of is a back side view thereof.

Designated by 12 is a heater substrate of $Al_2O_3$, AlN, SiC or another ceramic substrate having an electric insulation property, heat-resistivity, high thermal conductivity and a low thermal capacity, and has an elongated configuration having a thickness 1 mm, width 10 mm and length 240 mm.

Designated by 13 is a thin film heat generating resistor portion for generating heat by electric energization thereto, and is formed by applying (by screen printing or the like) and sintering a fine strip pattern of a paste of electric resistance material such as $TaSiO_2$, AgPd, $Ta_2N$, $RuO_2$ or nickel-chromium to a width of 1–3 mm and a thickness of several thousands of millions $\mu$m, along a length of a front surface of the substrate 12. It can be formed by evaporation, sputtering or the like.

Designated by 14*a* and 14*b* are a pair of first and second electrode patterns juxtaposed on one longitudinal end portion surface of the substrate surface; and 14*c* is an electroconductive path pattern formed substantially in parallel with the heat generating resistor portion 13.

The second electrode pattern 14*b* and an one end portion of the heat generating resistor portion 13 are electrically connected. The other end portion of the heat generating resistor portion 13 and one end portion of the electroconductive path pattern 14*c* at the same side are electrically connected. The other end portion of the electroconductive path pattern 14*c* is electrically connected with the first electrode pattern 14*a*.

An electrical path (AC line) is constituted by the first electrode pattern 14*a*, electroconductive path pattern 14*c*, heat generating resistor portion 13, electroconductive path pattern 14*c* and the second electrode pattern 14*b* in the order named.

Designated by 15*a* and 15*b*, are an one pair of third and fourth electrode patterns juxtaposed on a longitudinal end portion surface of the substrate surface.

Designated by 16 is a coating layer (heater surface protection layer) of heat resistive glass or the like covering the heat generating resistor portion 13 and the electroconductive path pattern 14*c* except for the first and second electrode patterns 14*a* 14*b* and the third and fourth electrode patterns 15*a*, 15*b* on the substrate front side.

Designated by 15*d*, 15*e* are two lines of electroconductive path patterns which are substantially parallel and which are formed on the back side of the heater substrate from a left end side to a substantially central portion in the longitudinal direction of the heater substrate.

Designated by 17 is a thermister as a temperature detecting element sintered on, or bonded by a heat resistive adhesive material on, the back side of the heater substrate connected between the end portions of the parallel electroconductive path patterns 15*d*, 15*c*.

The other end portion of one of the electroconductive path patterns 15*d*, is electrically connected with the third electrode pattern 15*a* on the heater front side through an electroconductive through hole 15*c*. The other end portion of the other electroconductive path patterns 15*c* is electrically connected with the fourth electrode pattern 15*b* on the heater front side through the electroconductive through hole 15*f*.

An electrical path (DC line) is constituted by the third electrode pattern 15*a*, the electroconductive through hole 15*c*, the electroconductive path pattern 15*d*, thermister 17, the electroconductive path pattern 15*e*, the electroconductive through hole 15*f* and the fourth electrode pattern 15*b* in the order named.

The first and second electrode patterns 14*a*, 14*b*, the electroconductive path pattern 14*c*, the third and fourth electrode patterns 15*a* and 15*b*, the electroconductive path patterns 15*d*, 15*e* or the like, are formed by applying a paste of electroconductive material such as Ag, for example, by screen printing the paste into a desired pattern and sintering the pattern.

The heater 11 is placed into the groove portion 23 of the lower surface of the heater holder 21 with the front side thereof faced outwardly.

When it is placed, such as end side as has the first and second electrode patterns 14*a* and 14*b* of the AC line of the heater 11 is in the groove portion 23 of the lower surface of the extended projected portion 22 of the one end side of the heater holder 21, and the other end side having the third and fourth electrode pattern 15*a*, 15*b* portions of the DC line of the heater 11 is placed in the groove portion 23 of the lower surface of the extended projected portion 22 of the other end side of the heater holder 21.

A heater connector 31 for the electric energy supply is mounted to the projected portion 22 at the one end side of the heater holder 21, as will be described in (4). In this state, the first and second spring contact portions 31*a*and 31*b* in the heater connector 31 for electric energy supply are press-contacted to the first and second electrode patterns 14*a*, 14*b* of the AC line of the heater 11, respectively, so that the electrical conduction and connection state is established.

AS will be described also in (4), the heater connector 32 for the temperature sensing is mounted to the projected portion 22 at the other side of the heater holder 21, and in this state, the first and second spring contact portions 32*a* and 32*b* in the heater connector 32 for the temperature sensing are press-contacted to the third and fourth electrode patterns 15*a*, 15*b* in the DC line of the heater 11, respectively, to establish the electrical conduction and connection state.

The electric power is supplied to between the first and second electrode patterns 14*a*, 14*b* in the AC line of the heater 11, through the AC driver 19 and lead wires 31*c*, 31*d* from the AC voltage source S, by the first and second spring contact portions 31*a* of the heater connector 31, so that the heat generating resistor portion 13 of the heater 11 generates heat over the total length to effect rapid temperature rise of the heater 11.

The rising temperature of the heater 11 is detected by thermister 17, and the sensed temperature information is supplied to the control means (CPU) 21 through the third and fourth electrode patterns 15*a*, 15*b* in the DC line, the first and second spring contact portions 32*a* and 32*b* of the heater connector 32 for the temperature sensing, the lead lines 32*c,* 32*d* and the A/D converter 20. The A/D converter 20 digitalizes the output of thermister 17 and supplies the digitalized signal to the control means 21.

The control means 21 controls the AC driver 19 including TRIAC or the like on the basis of the sensed heater temperature information supplied thereto, and controls the electric power supply to the heat generating resistor portion 13 of the AC line so as to maintain the surface temperature of the heater 11 at a predetermined heating temperature (fixing temperature), thus effecting the temperature control of the heater 11.

The electric power supply control to the heat generating resistor portion 13 uses phase control or wave number control, and for example, if the wave number control is used, 14 waves of the AC input voltage are used as a basic unit; and the input electric energy is changed by the number of waves out of the 14 waves supplied to the heat generating resistor portion 13. The on/off ration is expressed by duty ration, which can be changed in the range of 0–100%.

Designated by 18 is a temperature fuse as a safety element. It is interposed in series in the lead line 31*c*connecting the AC driver 19 and the first spring contact portion 31*a* of the heater connector 31, and is contacted to the back side, bonded thereto with a heat resistive adhesive material, or disposed close thereto. A heater runaway state occurs in which the electric energy supply to the heater 11 is effected without limit due to failure of the electric power supply control system or the like, the temperature fuse 16 operates in response to the over-heating of the heater 11 so that the electric power supply to the heat generating resistor portion 13 is shut off, to avoid the runaway state of the heater 11.

(4) Heater Connector 31, 32

Figure 6:
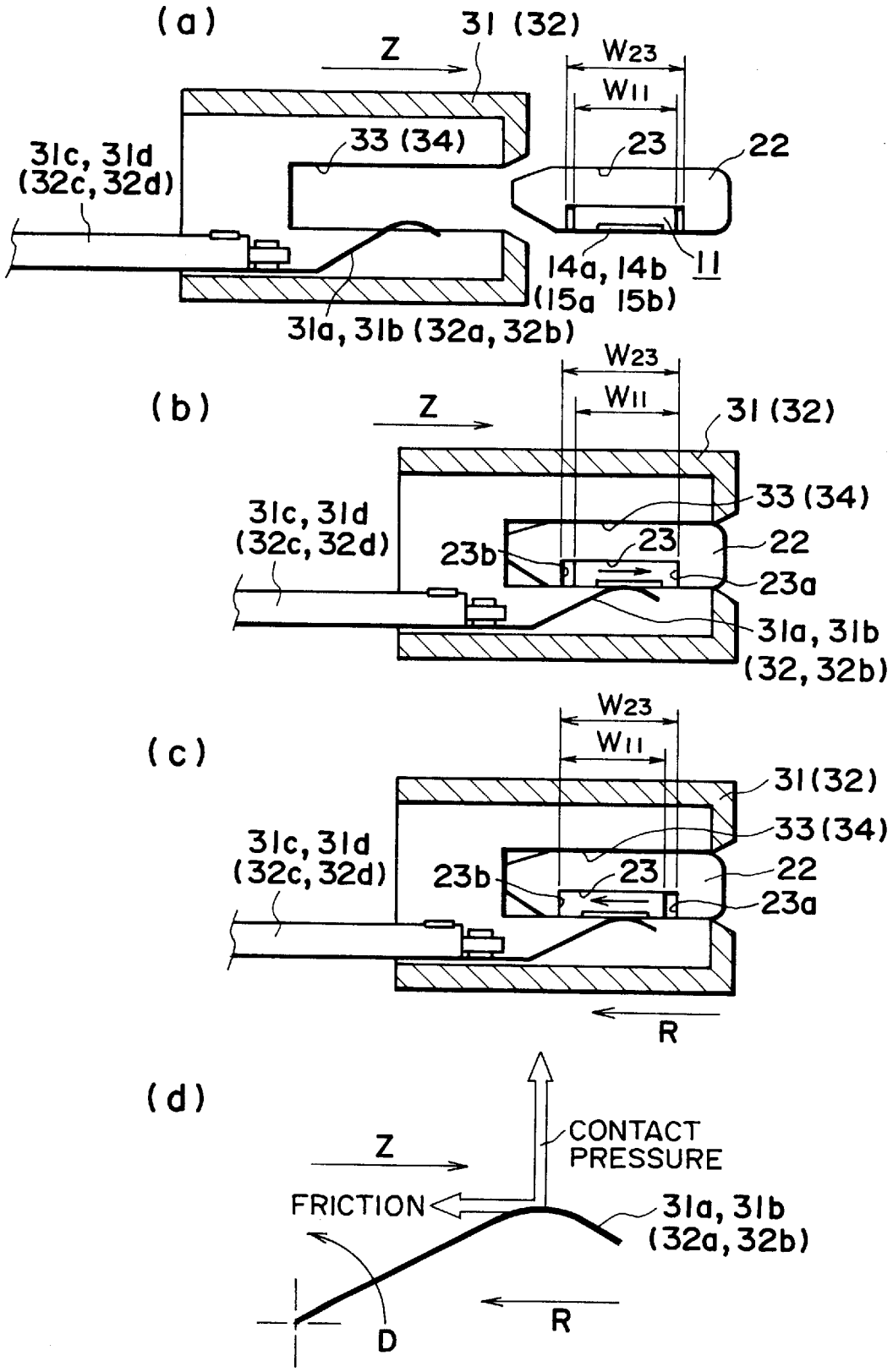
FIGS. 6(*a*)–(*d*) are an illustration of engagement of the heater with a connector.

FIG. 6 is an illustration of the structure of the heater connectors 31, 32 for the temperature sensing and the mounting thereof.

The heater connectors 31, 32 each comprises a housing portion and first end second spring contact portions 31*a,* 31*b,* 32*a,* 32*b,* said housing portion having an opening portion 33, 34 into which the extended projected portion 22, 22 of each of one and the other sides, is received while being sandwiched thereby at the upper surface and the lower surface thereof.

The spring contact portion 31*a,* 31*b* and 32*a,* 32*b* are of a material durable against the operating temperature of 180°–300° C., for example, Ti-Cu or the like.

The opening 33 of the heater connector 31, 32 is pushed to the projected portion 22, 22 of the heater holder 21 in the direction opposite from the rotational direction of the pressing roller 27 (film movement direction) in the heating nip N and in the direction perpendicular to the longitudinal direction of the heater, until the rear wall portion of the opening portion 33, 34 is abutted to by the heater connector locking insertion side of the projected portions 22, and therefore, the further movement is stopped (FIG. 6, (*a*) to (*b*)).

As has been described hereinbefore, the heater 11 is fitted into the groove portion 23 in the lower surface of the heater holder 21 with its front side facing outward, and the one side portion having the first and second electrode pattern 14*a,* 14*b* portions of the AC line of the heater 11 is in the groove portion 23 in the lower surface of the projected portion 22 at one side of the heater holder 21, so that the locking of the heater connector 31 to the projected portion 22 at one side of the heater holder 21 is effective to press-contact the first and second spring bonding portions 31*a,* 31*b* in the connector 31 to the first and second electrode patterns 14*a,* 14*b* of the AC line in the heater 11, so that electric connection is established.

The other end portion having the first and second electrode pattern 15*a,* 15*b* portions in DC line of the heater 11, is positioned in the groove portion 23 in the lower surface of the projected portion 22 at other end side of the heater holder 21, and therefore, the locking of the heater connector 32 to the projected portion 22 of the heater holder 21 at the other side is effective to press-contact the first and second spring contact portions 32*a,* 32*b* in the connector 32 to the first and second electrode patterns 15*a,* 15*b* in the DC line of the heater 11.

The urging force of each spring contact portions 31*a,* 31*b,* 32*a* and 32*b* to the associated electrode patterns is 50–300 g, in this embodiment.

At this time, one end of the heater 11 is pressed to the projected portion 22 side of the heater holder 21 by the spring contact portions 31*a,* 31*b* of the connector 31, and the other end of the heater 11 is pressed to the projected portion 22 side of the heater holder 21 by the spring contact portions 32*a,* 32*b* of the connector 32, so that the heater 11 is assuredly supported by the heater holder 21.

a) As has been described hereinbefore, in this embodiment, the width $W_{23}$ of the heater accommodation groove portion 23 of the heater holder 21 is selected to be larger than the width $W_{11}$ of the heater 11 by a predetermined degree, and the heater 11 is received by the groove portion 23 without bond-fixed, and therefore, the heater 11 is loosely fitted in the groove portion 23 of the holder 21, and since it is not bonded, there is provided a mobility (play) in the width in the groove portion 22. Thermal-expansion elongation, in the longitudinal direction, of the heater 11 is not limited, and therefore, is relatively free.

By the use of the loose fitting for the heater 11 into the heater holder 21, without the bond-fixing, the cost for the bonding process and the material cost can be saved.

In addition, the internal stress produced by thermal capacity difference and thermal-expansion difference between the heater 11 and the heater holder 21, can be opened, and the reduction of the heater lifetime due to the repeated fatigue or the damage of the heater 11 due to the internal stress, can be avoided.

b) On the other hand, the possible fluctuation of the electrical connection between the heater 11 and the heater connectors 31, 32 resulting from the loose fitting used without bonding or fixing, is avoided by mounting the heater connector 31, 32, as described above, in the direction Z opposite from the rotational direction of the pressing roller 27 in the heating nip N and in the direction perpendicular to the longitudinal direction of the heater 11.

The heater connector 31, 32 is pushed to the projected portion 22, 22 of the heater holder 21 in the direction opposite from the rotational direction of the pressing roller 27 (film movement direction) in the heating nip N and in the direction perpendicular to the longitudinal direction of the heater, until the rear wall portion of the opening portion 33, 34 is abutted to by the heater connector locking insertion side of the projected portions 22, and therefore, the further movement is stopped (FIG. 6, (*a*) to (*b*)). At this time, the heater 11 having the play in the width direction in the groove portion 23 receives shifting force by the contact frictional force from the spring contact portions 31*a,* 31*b* 32*a,* 32*b* of the heater connectors 31, 32 in the width of the groove portion 23. Thus, it is once at a shifted position by abutting to the downstream groove portion side wall 23*a,* in the direction Z, as shown in FIG. 6, (*b*).

When the pressing roller 27 is rotated in the direction R in this state, the heater 11 receives pressing roller rotation frictional force in the direction opposite from the direction Z through the film 26 and moves in the rotational direction R of the pressing roller 27 in the width of the groove portion 23 until it is stopped by the downstream groove portion side wall 23*b* in the opposite direction R direction, as shown in FIG. 6, (*c*); and it is set there.

At this time, the spring contact portions 31*a,* 31*b* 32*a,* 32*b* of the heater connectors 31 also receives frictional force from the electrode patterns 14*a,* 14*b* 15*1,* 15*b* of the heater 11 having been shifted in the opposite direction as described hereinbefore. This frictional force is effective to rotate spring contact portion 31*a,* 31*b,* 32*a,* 32*b* in the direction D, as shown in FIG. 6, (*d*). Since the spring contact portions 31*a,* 31*b* 32*a,* 32*b* are bent in the engaging direction relative to the corresponding electrode patterns 14*a,* 14*b* 15*a,* 15*b,* so that the contact pressure (contact pressure) of the spring contact portions 31*a,* 31*b,* 32*a* and 32*b* relative to the electrode patterns 14*a* 14*b,* 15*a,* 15*b* increases. Thus, electric connection between the heater 11 and the heater connector 31, 32 is reliable without fluctuation.

(5) Other Examples of Heating Device A

Figure 7:
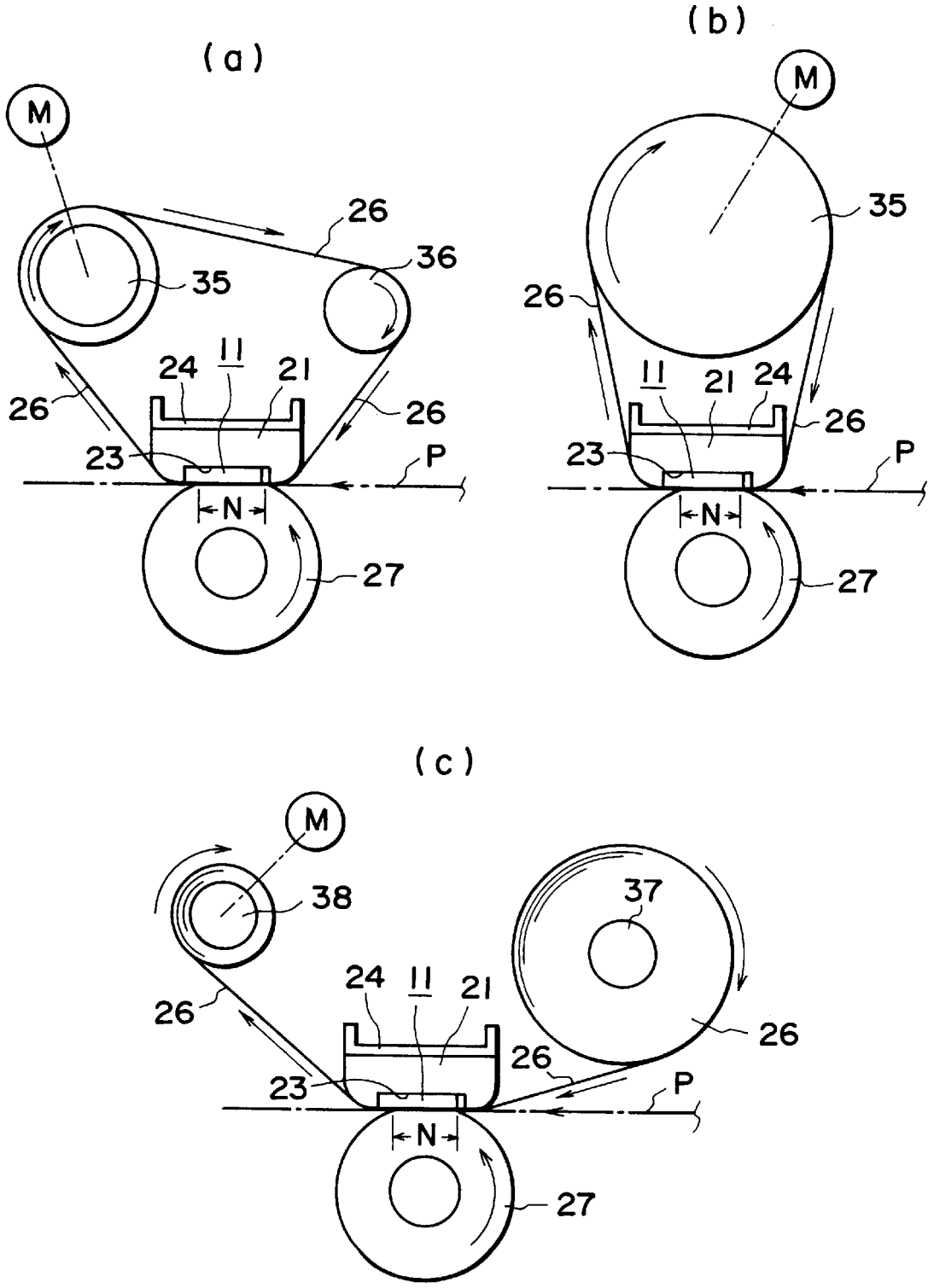
FIGS. 7(*a*)–(*c*) are an illustration of an image heating device of another example.

FIGS. 7, (*a*), (*b*) and (*c*) show other examples of film heating type heating devices A to which the present invention is applicable.

In (*a*), the endless belt type heat resistive film 26 is extended around 3 members, namely, a heater 11 supported on the heater holder 21, a film driving roller 35, and a tension roller 36, which are parallel, and the heater 11 and the pressing roller 27 are urged to each other with the film 26 therebetween to form a heating nip N, wherein the film 26 is rotated by the driving roller 35.

In (*b*), the endless belt type heat resistive film 26 is extended around two members, namely, a heater 11 supported on the heater holder 21 and a film driving roller 35, which are parallel, and the heater 11 and the pressing roller 27 are urged to each other with the film 26 therebetween to form a heating nip N, wherein the film 26 is rotated by the driving roller 35.

In (*c*), the heat resistive film 26 is not an endless film-like, but is a long rolled non-endless film which is supported on a thrust but shaft 37. It is extended by way of a bottom side of the heater 11 supported on the heater holder 21 to a take-up shaft 38. The heater 11 and the pressing roller 27 are press-contacted to each other with the film 26 therebetween, wherein the film is driven by the take-up shaft 38.

The present invention is applicable to the heating device A of any of such structures.

The heating device of the present invention is applicable not only to the image heat-fixing device of the foregoing examples but also to a device for improving the surface property (gloss or the like) by heating a recording material, a temporary fixing process, or heating device for dry process and lamination treatment of a fed sheet-like material.

The present invention is applicable not only to the heating device of the film heating type but also to a device wherein a pressing roller is directly press-contacted to the heater supported on the heater holder to form a heating nip, wherein a material to be heated is introduced to the heating nip.

The pattern structure of the heater 11, or the like, is not limited to the embodiments.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

a heater;

a supporting member for supporting said heater;

a film having a first side in slidable contact with said heater and a second side movable with a recording material carrying an image in contact therewith;

wherein the image on the recording material is heated by heat from said heater through said film;

wherein said heater is movably supported on a heater supporting portion of said supporting member without adhesive material therebetween.

2. An apparatus according to claim 1, wherein said heater supporting portion has a recess which receives said heater with play.

3. An apparatus according to claim 2, wherein said heater is elongated, and the play is provided to permit movement of said heater in a longitudinal direction of said heater and in a direction perpendicular to longitudinal direction thereof.

4. An apparatus according to claim 1, wherein said heater includes a heat generating element for generating heat upon electric energization.

5. An apparatus according to claim 4, further comprising a connector for electric energization of said heat generating element, wherein said connector urges said heater to said supporting member.

6. An apparatus according to claim 5, wherein said heater is movable in a direction perpendicular to a direction of urging by said connector.

7. An apparatus according to claim 1, wherein said heater has a temperature detecting element for detecting a temperature.

8. An apparatus according to claim 7, further comprising a connector for electric energization of said temperature detecting element, wherein said connector urges said heater to said supporting member.

9. An apparatus according to claim 1, further comprising a pressing roller for forming a nip with said heater with said film interposed therebetween.

10. An apparatus according to claim 9, wherein said pressing roller is a driving roller for driving said film.

11. An apparatus according to claim 9, wherein an unfixed image is fixed on the recording material.

12. An apparatus according to claim 5, wherein said connector is engaged with said heater in a direction opposite from a movement direction of said film.

13. An apparatus according to claim 9, wherein said connector is engaged with said heater in a direction opposite from a movement direction of said film.

14. An image heating apparatus comprising:

a heater;

a supporting member for supporting said heater;

a film having a first side in slidable contact with said heater and a second side movable with a recording material carrying an image in contact therewith;

a connector for supplying electric energy to said heater;

wherein the image on the recording material is heated by heat from said heater through said film, and wherein said heater is supported on said supporting member by said connector without adhesive material therebetween.

15. An apparatus according to claim 14, wherein said connector urges said heater toward said supporting member.

16. An apparatus according to claim 14, wherein said heater includes a heating element for generating heat by electric energy supply thereto, and said heating element is supplied with the electric energy through said connector.

17. An apparatus according to claim 14, further comprising a temperature detecting element, provided on said heater, for detecting a temperature, and said temperature detecting element is supplied with electric energy through said connector.

* * * * *

UNITED STATES PATENT AND TRADEMARK OFFICE

CERTIFICATE OF CORRECTION

PATENT NO. : 5,828,035
DATED : October 27, 1998
INVENTOR(S) : Akira Kuroda

It is certified that error appears in the above-identified patent and that said Letters Patent is hereby corrected as shown below:

Column 1,
Line 15, “Application No.” should read -- Application Nos. --;
Line 16, “In this,” should read -- In this heating device, --;
Line 37, “of” should read -- or --;
Line 52, “heater, man-hour” should read -- heater, the man-hours --; and
Line 53, “is” should read -- are --.

Column 3,
Line 49, “an” should be deleted;
Line 50, “has” should read -- have --; and
Line 62, “tetrafluroethyrene” should read -- tetrafluroethylene --.

Column 4,
Line 13, “A1” should read -- A4 --;
Line 21, “a” should be deleted;
Line 35, “function” shouold read -- functions as a --; and
Line 60, “into” should be deleted.

Column 5,
Line 41, “an” should be deleted;
Line 54, “an” should be deleted; and
Line 61, “14a” should read -- 14a, --.

Column 6,
Line 29, “as” (1st occurrence) should read -- an --;
Line 41, “31 aand” should read -- 31a and --; and
Line 46, “AS” should read -- As --.

Column 7,
Line 19, “ration,” should read -- ratio, --; and
Line 26, “A” should read -- When a --.

Column 9,
Lines 18 and 25, “31b32a,” should read -- 31b, 32a, --;
Line 20, “14b151,” should read -- 14b, 15a, --;
Line 26, “14b15a,” should read -- 14b, 15a, --;
Line 27, “(contact pressure)” should be deleted; and

UNITED STATES PATENT AND TRADEMARK OFFICE

CERTIFICATE OF CORRECTION

PATENT NO. : 5,828,035
DATED : October 27, 1998
INVENTOR(S) : Akira Kuroda

It is certified that error appears in the above-identified patent and that said Letters Patent is hereby corrected as shown below:

Column 9 (contd),
Line 51, “14a14b,” should read -- 14a, 14b, --, and “film-like,” should read -- film-like one, --.

Column 10,
Line 65, “claim 9,” should read -- claim 8, --.

Signed and Sealed this

Thirteenth Day of July, 2004

JON W. DUDAS
*Acting Director of the United States Patent and Trademark Office*